US008162238B2

(12) United States Patent
Tseng

(10) Patent No.: US 8,162,238 B2
(45) Date of Patent: Apr. 24, 2012

(54) SPRAY TYPE LIQUID PRESSURE HEAD

(75) Inventor: Kun-Lung Tseng, Taichung Hsien (TW)

(73) Assignee: Living Fountain Plastic Industrial Co., Ltd., Dali, Taichung County (TW)

( * ) Notice: Subject to any disclaimer, the term of this patent is extended or adjusted under 35 U.S.C. 154(b) by 396 days.

(21) Appl. No.: 12/611,194

(22) Filed: Nov. 3, 2009

(65) Prior Publication Data

US 2011/0101130 A1 May 5, 2011

(51) Int. Cl.
*B05B 1/34* (2006.01)

(52) U.S. Cl. ..... 239/490; 239/333; 239/463; 239/468; 239/496; 239/600; 222/321.9

(58) Field of Classification Search ..... 239/470, 239/489, 490, 333, 463, 468, 493, 496, 503, 239/600; 222/321.8, 321.9
See application file for complete search history.

(56) References Cited

U.S. PATENT DOCUMENTS

| | | | | |
|---|---|---|---|---|
| 2,519,640 | A * | 8/1950 | Echols, Sr. et al. | 222/321.9 |
| 4,512,501 | A * | 4/1985 | Foster | 222/153.13 |
| 2007/0051831 | A1* | 3/2007 | Kuo | 239/333 |
| 2011/0049268 | A1* | 3/2011 | Chien | 239/498 |

* cited by examiner

*Primary Examiner* — Dinh Nguyen
*Assistant Examiner* — Jennifer Gordon
(74) *Attorney, Agent, or Firm* — Egbert Law Office PLLC

(57) ABSTRACT

A spray liquid pressure head has a main head body containing a suction body, a suction pipe and a container locking ring. A pressing member assembled over the main head body has a pressure head and horizontal expansion pipe. A directional jack is assembled at one end of the horizontal expansion pipe. Two reinforced costal margins are integrally formed at both sides of the horizontal expansion pipe in a vertical extension state. One end of the reinforced costal margin is integrally linked to the pressure head, and the other end integrally linked to the directional jack. The pressure head has a combined directional sprinkler head containing a labyrinth connecting pipe, a vertical terminal pipe and a spraying guide assembly.

6 Claims, 6 Drawing Sheets

SPRAY TYPE LIQUID PRESSURE HEAD

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a liquid pressure head, and more particularly to an innovative one which has a spray type pressure head.

2. Description of Related Art Including Information Disclosed Under 37 CFR 1.97 and 37 CFR 1.98.

The currently available emulsion bottled products are generally designed in a way that the emulsion or other liquid is discharged by a pressure head assembled on the port of the bottle. According to the typical structural configuration of the pressure head, the emulsion for discharge is in a blocky state, making it not ideal for some kinds of products like hand cleansers. If the discharged emulsion can be dispersed quickly and distributed uniformly onto the hands, it is possible to reduce the manual kneading for ease-of-use.

Though a spray type liquid pressure head has been developed, there is still a room for improvement in structural stability and assembly convenience due to imperfect construction. Thus, to overcome the aforementioned problems of the prior art, it would be an advancement in the art to provide an improved structure that can significantly improve the efficacy. Therefore, the inventor has provided the present invention of practicability after deliberate experimentation and evaluation based on years of experience in the production and development of related products.

BRIEF SUMMARY OF THE INVENTION

Based on the structural configuration that the reinforced costal margin is vertically extended to be formed at both sides of the horizontal expansion pipe of the pressing member, and one end of the reinforced costal margin is integrally linked to the pressure head, and the other end integrally linked to the directional jack, the transversely extended pressure head and horizontal expansion pipe of the pressing member can be supported and reinforced strongly to withstand long-term pressing and other external forces, realizing better structural stability and applicability.

Based on the structural configuration that a directional jack at the bottom of the horizontal expansion pipe is used for assembly and positioning of the directional assembly portion of the combined directional sprinkler head, the combined directional sprinkler head can thus be assembled more accurately and quickly with improved applicability.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
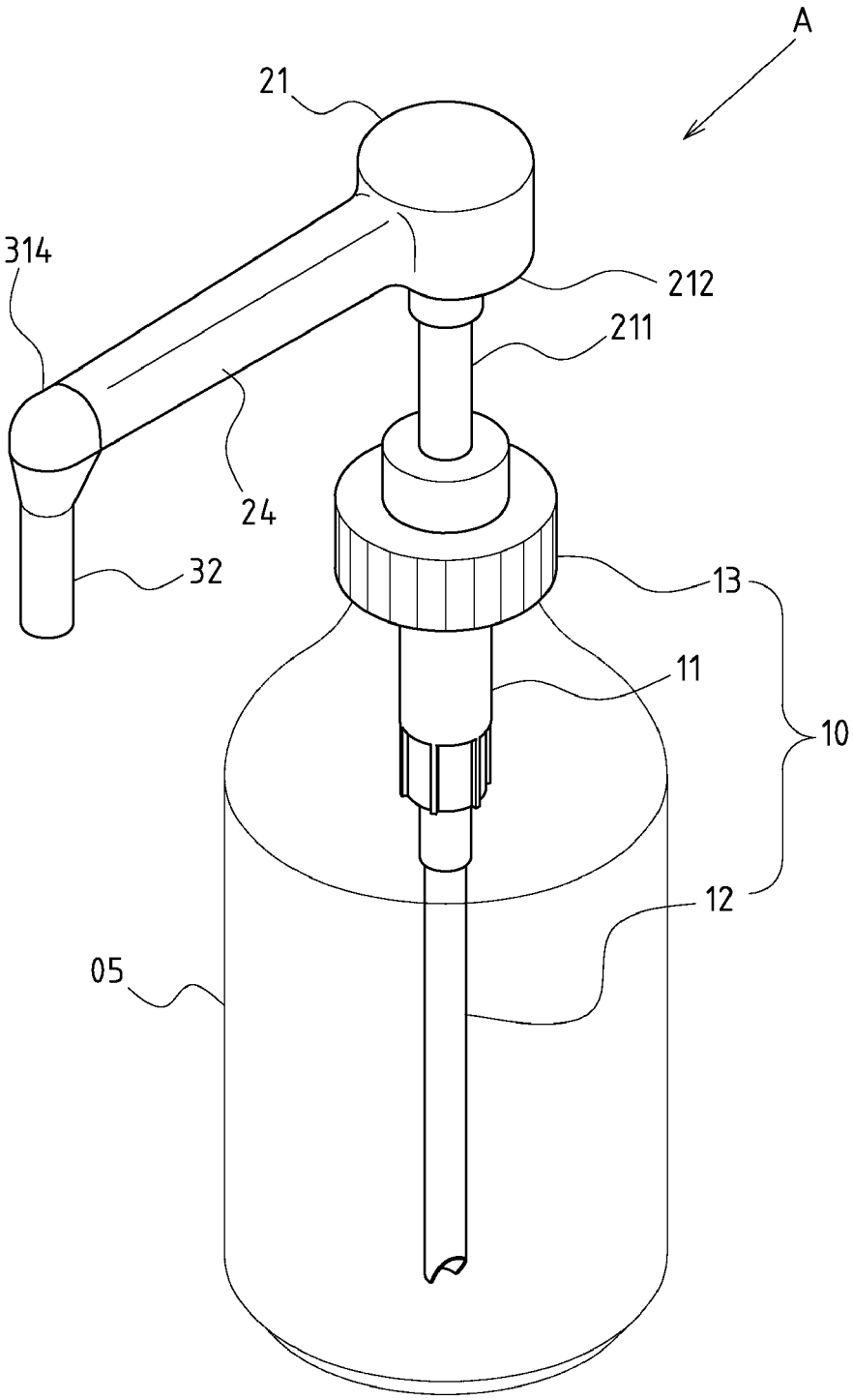
FIG. 1 shows a perspective view of the present invention where the spray type liquid pressure head as assembled onto the port of the bottle.

FIGS. 1-4 depict preferred embodiments of a spray type liquid pressure head of the present invention, which are provided for only explanatory objective for patent claims. The spray type liquid pressure head A includes:

a main head body 10, containing a suction body 11, a suction pipe 12 and a container locking ring 13; of which the suction body 11 is hollow and fitted with a suction member 14 (marked in FIG. 6); the suction pipe 12 is assembled at bottom of the suction body 11 in a downward extension state; the container locking ring 13 is assembled at top of the suction body 11, so that the spray type liquid pressure head A is assembled fixedly onto the port of an existing container 05 (referring to FIG. 1);

a pressing member 20, which is assembled over the main head body 10; the pressing member 20 contains a pressure head 21 and a horizontal expansion pipe 22; a delivery pipe 211 is vertically extended from the bottom of the pressure head 21; the bottom of the delivery pipe 211 can be inserted into suction body 11 of the main head body 10 in a lifting state; one end of the horizontal expansion pipe 22 is linked integrally with the pressure head 21 and connected to the delivery pipe 211;

a directional jack 23, which is assembled at the other end of the horizontal expansion pipe 22; the directional jack 23 is provided with a directional positioning portion 231;

two reinforced costal margins 24, which are integrally formed at both sides of the horizontal expansion pipe 22 of the pressing member 20 in a vertical extension state; moreover, one end of the reinforced costal margin 24 is integrally linked to the pressure head 21, and the other end integrally linked to the directional jack 23; and a combined directional sprinkler head 30, containing a labyrinth connecting pipe 31, a vertical terminal pipe 32 and a spraying guide assembly 33; the labyrinth connecting pipe 31 contains a vertical piping portion 311 and a directional assembly portion 312 extended horizontally; the directional assembly portion 312 is inserted into the directional jack 23, and the directional assembly portion 312 is provided with a directional spacer 313 for mating with the directional positioning portion 231 of the directional jack 23; an orifice 321 is placed at the bottom of the vertical terminal pipe 32, and a mating hole 322 placed at its top for sleeving onto the vertical piping portion 311 of the labyrinth connecting pipe 31; the spraying guide assembly 33 is assembled between the vertical piping portion 311 and the orifice 321 of the vertical terminal pipe 32; the spraying guide assembly 33 contains a plurality of diverting portions 331 at the top, a plurality of diverting grooves 332 around it, and a spiral collecting tray 333 at the bottom; the diverting portion 331 is abutted by the vertical piping portion 311, and the spiral collecting tray 333 is aligned with the orifice 321 of the vertical terminal pipe 32.

Figure 2:
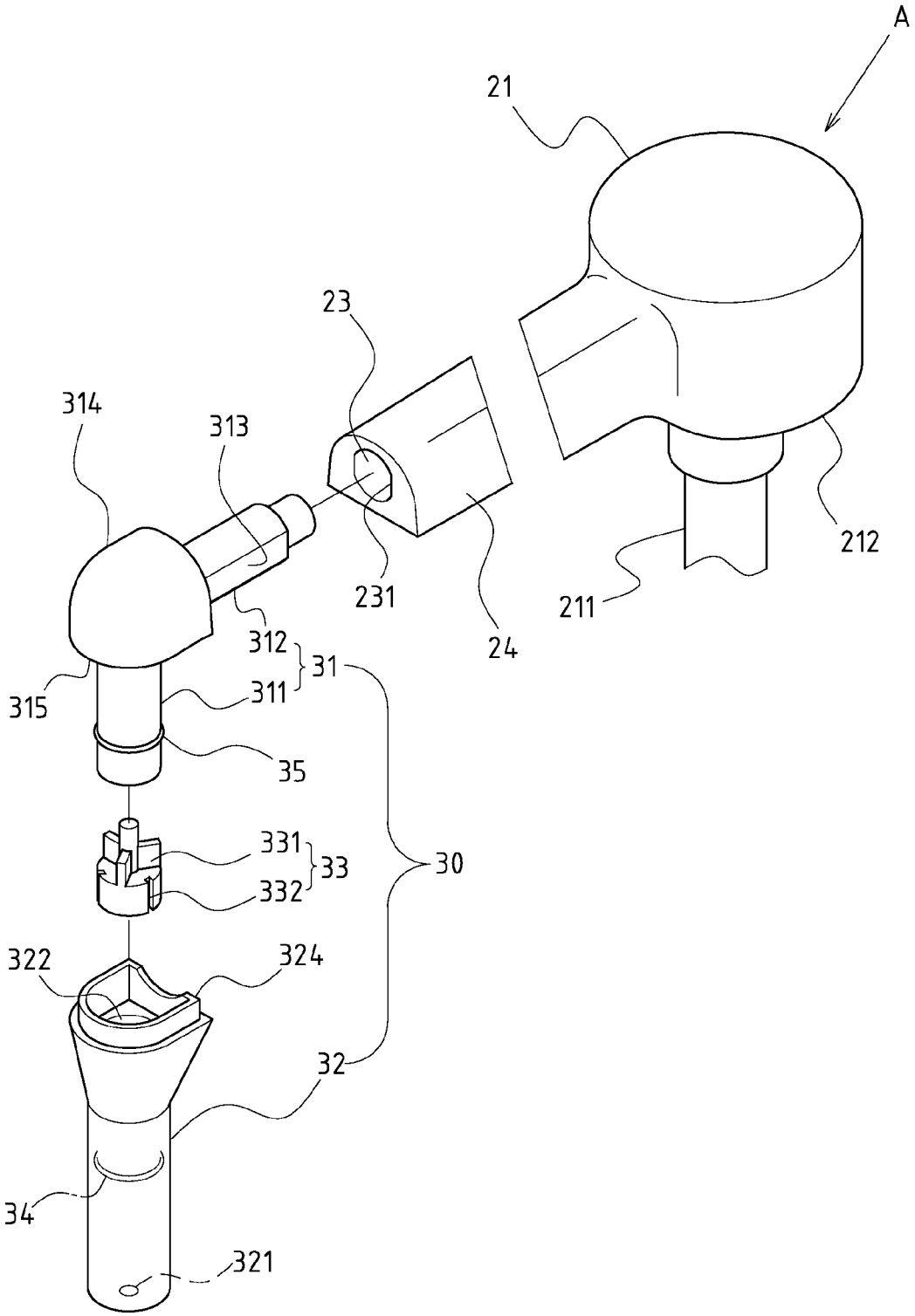
FIG. 2 shows a partially exploded perspective view of the spray type liquid pressure head of the present invention.
Figure 4:
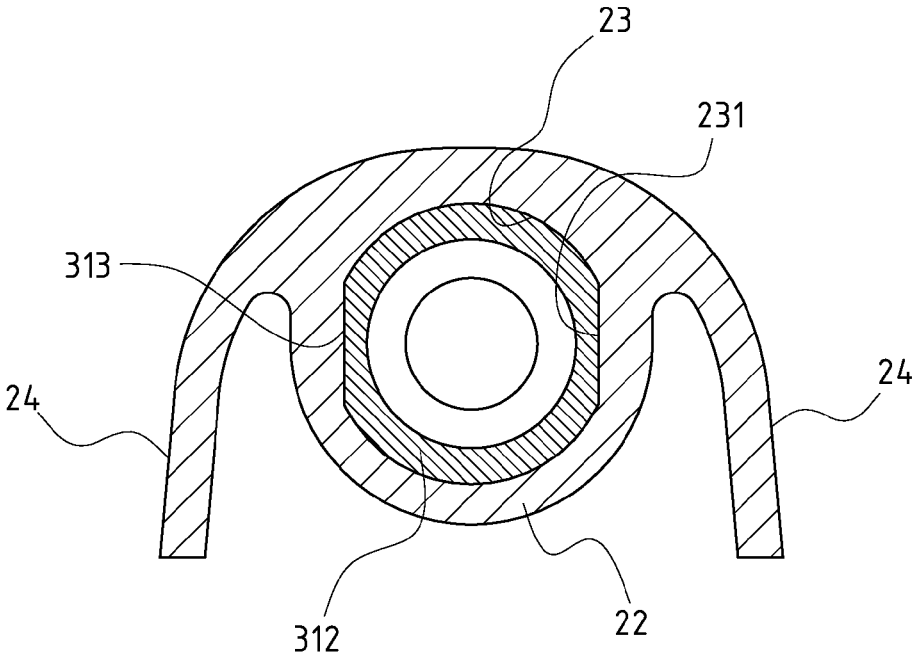
FIG. 4 shows a cross sectional view of the pressing member of the present invention.
Figure 5:
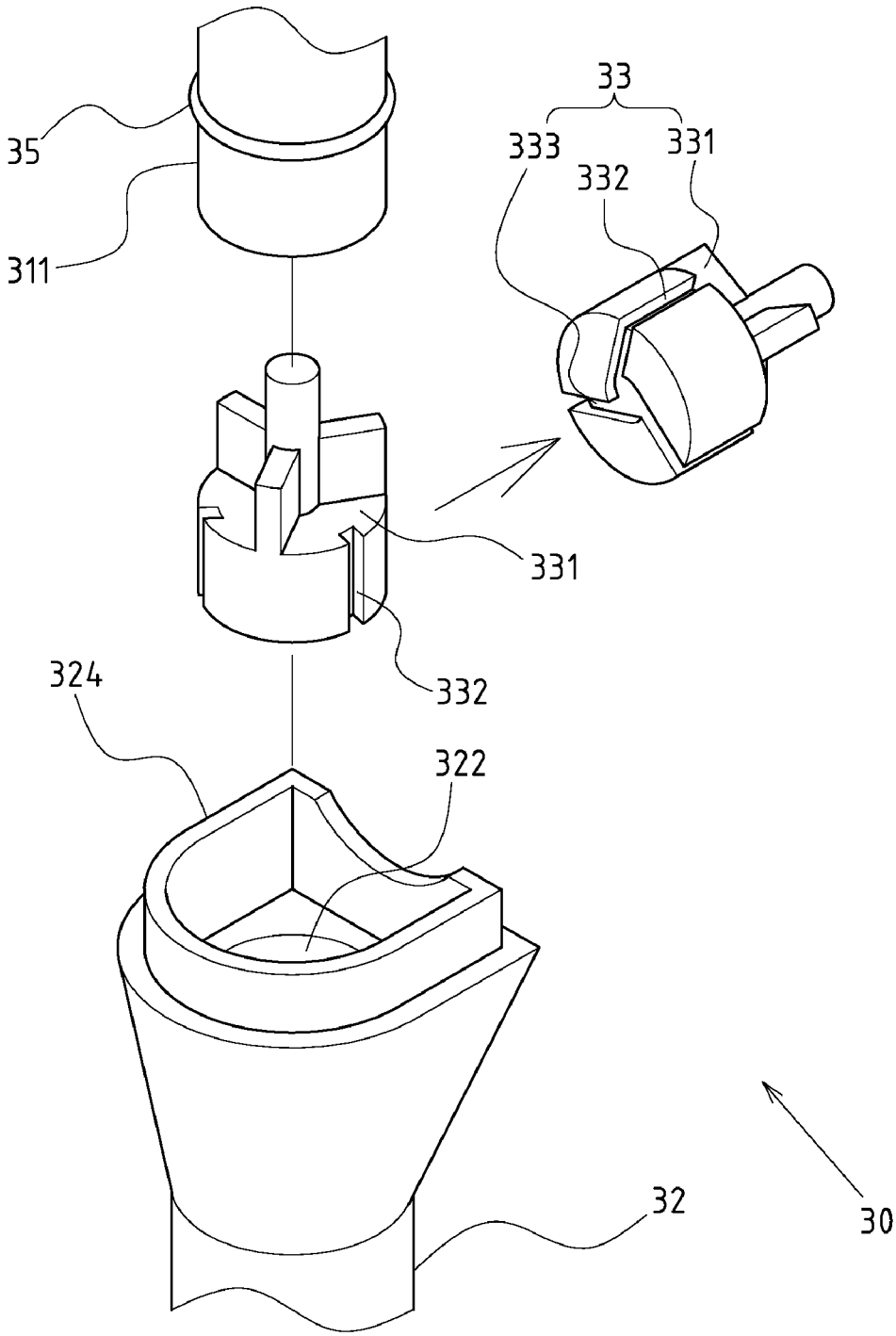
FIG. 5 shows an isolated schematic view of the combined directional sprinkler head of the present invention.

Referring to FIGS. 2 and 4, the directional jack 23 is configured into a round hole, and the directional positioning portion 231 is of side grain pattern. The directional assembly portion 312 set for the labyrinth connecting pipe 31 of the combined directional sprinkler head 30 is of a round pipe pattern, and the directional spacer 313 is of the same side grain pattern.

Figure 3:
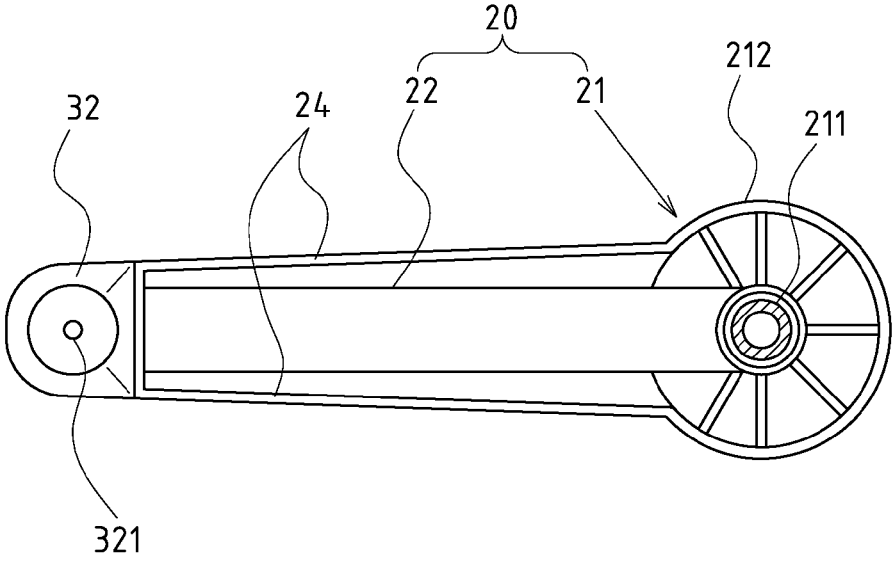
FIG. 3 shows an top view of the pressing member of the present invention.

Referring to FIGS. 2 and 3, the bottom of the pressure head 21 is provided with an architrave 212, which is integrally linked with one end of the reinforced costal margin 24.

Figure 7:
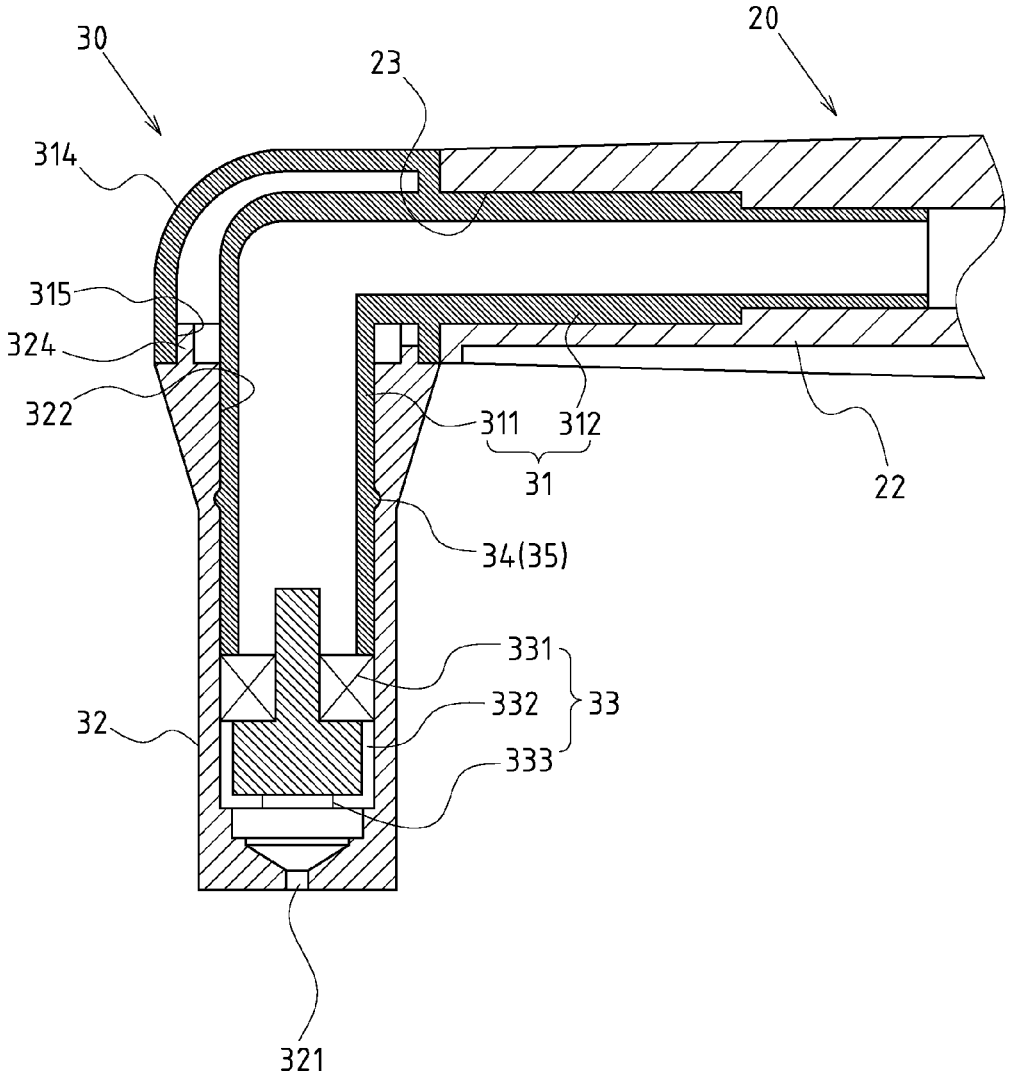
FIG. 7 shows an isolated schematic view of the combined directional sprinkler head of the present invention.

Referring to FIGS. 2 and 7, an expanded boss 314 is arranged between the vertical piping portion 311 of the labyrinth connecting pipe 31 and the directional assembly portion 312. An insertion hole 315 is placed at bottom of the expanded boss 314 so that an insertion flange 324 is formed at the mating hole 322 on top of the vertical terminal pipe 32, and also interlocked securely with the aforementioned insertion hole 315.

Referring to FIGS. 2 and 7, a circular dent 34 and a circular flange 35 allowing for interlocking are arranged at the mating hole 322 on top of the vertical terminal pipe 32 and the vertical piping portion 311 of the labyrinth connecting pipe 31.

Figure 6:
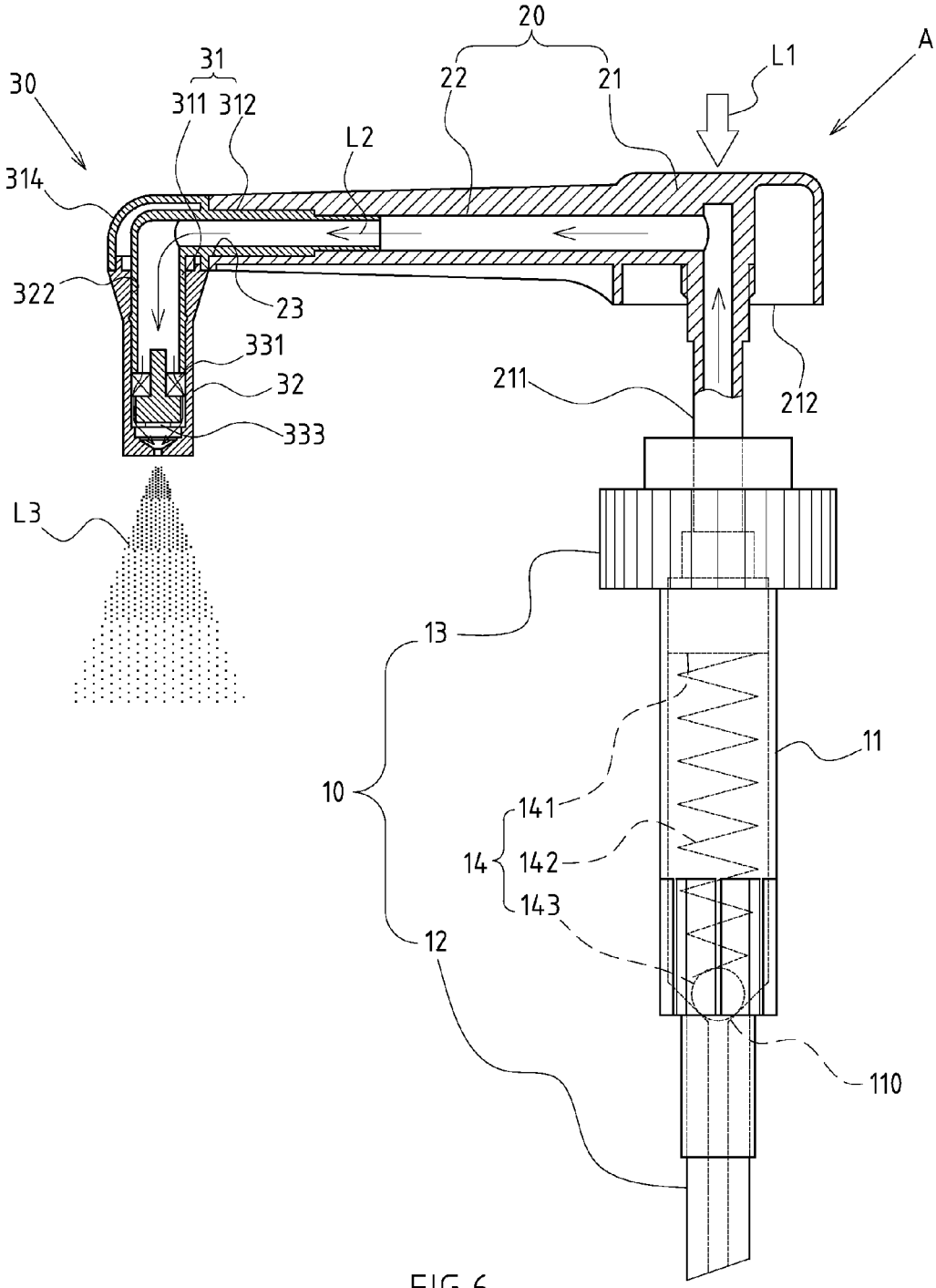
FIG. 6 shows a schematic view of the spray type liquid pressure head of the present invention.

Referring also to FIG. 6, the suction member 14 includes a piston 141, a restoring spring 142 and a steel ball 143. The top of the piston 141 is coupled with the bottom of the delivery pipe 211 of the pressing member 20. The steel ball 143 is placed onto the tapering hole 110 preset at the inner bottom of the suction body 11 and the restoring spring 142 is used to support elastically the piston 141.

Based on above-specified structural configuration, the present invention is operated as follows.

Referring also to FIG. 6, the spray type liquid pressure head A is operated in the same way with typical one. The user just applies a downward pressure onto the pressure head 21 of the pressing member 20 (shown by arrow L1) in tune with the operation of the suction member 14 (as demonstrated in prior art), the liquid accumulated in the suction body 11 (shown by arrow L2) can pass the delivery pipe 211 and horizontal expansion pipe 22 to reach the combined directional sprinkler head 30. When the liquid passes through the spraying guide assembly 33 within the combined directional sprinkler head 30, it will be diverted through the diverting portion 331 and diverting groove 332. The liquid is then collected vertically through the spiral collecting tray 333, so that the liquid can be sprayed out of the orifice 321 of the vertical terminal pipe 32 in a foggy state (shown by arrow L3).

I claim:

1. A spray type liquid pressure head comprising:

a main head body having a suction body, a suction pipe and a container locking ring, of which the suction body is hollow and fitted with a suction member, the suction pipe is assembled at a bottom of the suction body in a downward extension state, the container locking ring is assembled at a top of the suction body, so that the spray type liquid pressure head is assembled fixedly onto a port of an existing container;

a pressing member assembled over the main head body, the pressing member has a pressure head and a horizontal expansion pipe, a delivery pipe is vertically extended from a bottom of the pressure head, a bottom of the delivery pipe can be inserted into the suction body of the main head body in a lifting state, one end of the horizontal expansion pipe is linked integrally with the pressure head and connected to the delivery pipe;

a directional jack assembled at an other end of the horizontal expansion pipe having a directional positioning portion;

two reinforced costal margins integrally formed at both sides of the horizontal expansion pipe of the pressing member in a vertical extension state, one end of each of the reinforced costal margins being integrally linked to the pressure head, and the other end of each of the reinforced costal margins being integrally linked to the directional jack;

a combined directional sprinkler head having a labyrinth connecting pipe, a vertical terminal pipe and a spraying guide assembly, the labyrinth connecting pipe contains a vertical piping portion and a directional assembly portion extended horizontally, the directional assembly portion is inserted into the directional jack, and the directional assembly portion is provided with a directional spacer for mating with the directional positioning portion of the directional jack, an orifice is placed at a bottom of the vertical terminal pipe, and a mating hole is placed at a top of said vertical terminal pipe for sleeving onto the vertical piping portion of the labyrinth connecting pipe, the spraying guide assembly is assembled between the vertical piping portion and the orifice of the vertical terminal pipe, the spraying guide assembly contains a plurality of diverting portions at a top of the spraying guide assembly, a plurality of diverting grooves around the spraying guide assembly, and a spiral collecting tray at a bottom of the spraying guide assembly, the diverting portion is abutted by the vertical piping portion, and the spiral collecting tray is aligned with the orifice of the vertical terminal pipe.

2. The structure defined in claim 1, wherein the directional jack is designed into a round hole, and the directional positioning portion is of a side grain pattern so the directional assembly portion set for the labyrinth connecting pipe of the combined directional sprinkler head is of a round pipe pattern, and the directional spacer is of the same side grain pattern.

3. The structure defined in claim 1, wherein the bottom of the pressure head is provided with an architrave integrally linked with one end of each of the reinforced costal margins.

4. The structure defined in claim 1, wherein an expanded boss is arranged between the vertical piping portion of the labyrinth connecting pipe and the directional assembly portion, an insertion hole being placed at a bottom of the expanded boss so that an insertion flange is formed at the mating hole on a top of the vertical terminal pipe, and also interlocked securely with the insertion hole.

5. The structure defined in claim 1, wherein a circular dent and a circular flange allowing for interlocking are arranged at the mating hole on the top of the vertical terminal pipe and the vertical piping portion of the labyrinth connecting pipe.

6. The structure defined in claim 1, wherein the suction member contains a piston, a restoring spring and a steel ball.

* * * * *